US008903118B2

(12) United States Patent
Fujita et al.

(10) Patent No.: US 8,903,118 B2
(45) Date of Patent: Dec. 2, 2014

(54) DIAPHRAGM AND SPEAKER

(75) Inventors: Takeshi Fujita, Kobe (JP); Hiroshi Kubota, Kobe (JP)

(73) Assignee: TOA Corporation, Kobe-shi (JP)

( * ) Notice: Subject to any disclaimer, the term of this patent is extended or adjusted under 35 U.S.C. 154(b) by 701 days.

(21) Appl. No.: 12/675,750

(22) PCT Filed: Mar. 5, 2008

(86) PCT No.: PCT/JP2008/000447

§ 371 (c)(1),
(2), (4) Date: Aug. 10, 2010

(87) PCT Pub. No.: WO2009/028121

PCT Pub. Date: Mar. 5, 2009

(65) Prior Publication Data

US 2010/0296687 A1 Nov. 25, 2010

(30) Foreign Application Priority Data

Aug. 29, 2007 (JP) ..... 2007-222621

(51) Int. Cl.

| | |
|---|---|
| ***H04R 1/00*** | (2006.01) |
| ***H04R 7/02*** | (2006.01) |
| ***G10K 13/00*** | (2006.01) |
| ***H04R 7/14*** | (2006.01) |

(52) U.S. Cl.

CPC ..... *H04R 7/14* (2013.01)
USPC ..... 381/398; 181/173; 181/168

(58) Field of Classification Search

USPC ..... 381/425, 430, 398; 181/167, 173, 168
See application file for complete search history.

(56) References Cited

U.S. PATENT DOCUMENTS

| | | | | |
|---|---|---|---|---|
| 4,817,165 | A * | 3/1989 | Amalaha | 381/425 |
| 2003/0219141 | A1* | 11/2003 | Sugata et al. | 381/430 |
| 2005/0078850 | A1* | 4/2005 | Norton | 381/423 |
| 2009/0175487 | A1* | 7/2009 | Tsuchiya | 381/425 |

FOREIGN PATENT DOCUMENTS

| | | |
|---|---|---|
| JP | 31-653 | 2/1931 |
| JP | 32-6206 | 6/1932 |
| JP | 53-82329 | 12/1951 |
| JP | 62-48899 | 3/1987 |
| JP | 6-225385 | 8/1994 |
| JP | 2003-339094 | 11/2003 |

OTHER PUBLICATIONS

Claim Translation for Japanese Patent Publication Sho 31-653, Feb. 3, 1931.

(Continued)

*Primary Examiner* — Duc Nguyen
*Assistant Examiner* — Phan Le
(74) *Attorney, Agent, or Firm* — Marshall, Gerstein & Borun LLP

(57) ABSTRACT

The present invention provides a dome diaphragm having high strength wholly and uniformly while maintaining a small thickness of a dome portion. A diaphragm 1 according to the present invention is a dome diaphragm including a dome portion 2. The dome portion 2 is divided into a plurality of small portions 4, and a ridge portion 7 is formed at a boundary of the small portions 4. In accordance with this configuration, the ridge portions 7 exist over the entire dome portion 2, and the ridge portions 7 can serve as frames for reinforcing the dome portion 2.

15 Claims, 10 Drawing Sheets

(56) References Cited

OTHER PUBLICATIONS

Claim Translation for Japanese Patent Publication Sho 32-6206, Jun. 27, 1932.

Claim Translation for Japanese Patent Publication Sho 53-82329, Dec. 10, 1951.

International Search Report for PCT/JP2008/000447, mailed Jul. 22, 2008.

* cited by examiner (a)

(b)

DIAPHRAGM AND SPEAKER

TECHNICAL FIELD

The present invention relates to a diaphragm used in a speaker, and particularly to a dome diaphragm including a dome portion. The present invention also relates to a dome speaker including the above diaphragm.

BACKGROUND ART

Diaphragms used in speakers differ in shape depending on their use. Examples of the diaphragm are a cone diaphragm, a flat-plate diaphragm, and a dome diaphragm. A dome speaker using the dome diaphragm is characterized in that a diameter thereof can be reduced since a driving point is located on an outer periphery thereof. Since the dome diaphragm has a dome shape, it is difficult to increase the strength thereof by a multi-layer structure including a honeycomb layer as in the flat-plate diaphragm, and a method for increasing the strength of the dome diaphragm is limited. The simplest method for increasing the strength of the dome diaphragm is to increase the thickness of the diaphragm. However, if the dome diaphragm increases in thickness, this causes some downsides, i.e., it is difficult for such dome diaphragm to reproduce high-frequency sounds, and the cost increases. Here, Patent Document 1 proposes a diaphragm in which a dome portion is provided with a reinforcing rib. In accordance with this configuration, because the dome portion is reinforced by the rib, the dome diaphragm other than the rib can be reduced in thickness.

Patent Document 1: Japanese Utility Model Application Publication No. 53-82329

DISCLOSURE OF THE INVENTION

Problems to be Solved by the Invention

The diaphragm having the rib increases in strength overall. However, locally, the portion where the rib is formed is high in strength, but the other portion is low in strength. Thus, the strength differs depending on the portions. Therefore, the diaphragm having the rib tends to cause divided vibrations. In addition, if a force is applied to the portion other than the rib, a stress concentrates on a boundary between the rib and the portion other than the rib, and a portion in the vicinity of the boundary tends to be damaged. For example, if a strong mode is generated at the potion other than the rib, damages may occur at the boundary between the rib and the portion other than the rib.

Here, an object of the present invention is to provide a dome diaphragm having high strength wholly and uniformly while maintaining a small thickness of a dome portion. Another object of the present invention is to provide a dome speaker including such diaphragm.

Means for Solving the Problem

The present invention was made in light of the above-described circumstances, and a diaphragm according to the present invention is a dome diaphragm including a dome portion, wherein: the dome portion is divided into a plurality of small portions; and a ridge portion is formed at a boundary of the small portions. Here, the above "ridge portion" denotes a line segment formed by two adjacent surfaces contacting each other, and the two adjacent surfaces may contact each other so as to form a mountain shape or a valley shape. In accordance with this configuration, the ridge portions are formed over the entire dome portion, and the ridge portions can serve as frames for reinforcing the dome portion.

Moreover, in the above diaphragm, the ridge portion may be linear. In accordance with this configuration, the stiffness of the dome portion can be further increased.

Moreover, in the above diaphragm, the small portion may be planar. In accordance with this configuration, a large number of ridge portions serving as the frames can be formed although the configuration is comparatively simple.

Moreover, in the above diaphragm, the small portion may be a planar triangle, a planar quadrangle, or a planar hexagon. Here, the side of the planar polygon (the planar triangle, the planar quadrangle, and the planar hexagon) may be linear in a strict sense or may be slightly curved.

Moreover, in the above diaphragm, the ridge portions each having a mountain shape may be formed over the entire dome portion. In accordance with this configuration, the dome portion having a comparatively smooth surface can be formed.

Moreover, in the diaphragm in which the ridge portions each having the mountain shape are formed over the entire dome portion, a material of the dome portion may be a metal.

Moreover, in the above diaphragm, the ridge portions each having a mountain shape and the ridge portions each having a valley shape may be formed over the entire dome portion. In accordance with this configuration, an angle of a cross section of the ridge portion formed at the boundary of the small portions (angle between two planes forming the ridge portion) is reduced. Therefore, the stiffness of the dome portion can be further increased.

Moreover, in the above diaphragm, the dome portion may be formed by a plurality of polygonal pyramids, and the polygonal pyramid may be formed by the plurality of small portions each having a planar triangle shape. Here, the above "polygonal pyramid" may be a polygonal pyramid in which the ridge portion formed at the boundary of the small portions is slightly round. In accordance with the above configuration, the ridge portions can be formed efficiently. Therefore, the stiffness of the dome portion can be further increased.

Moreover, in the above diaphragm, the polygonal pyramid may be a triangular pyramid, a four-sided pyramid, or a six-sided pyramid.

Moreover, in the above diaphragm, the small portion may be inwardly depressed or projects outwardly. In accordance with this configuration, the angle of the cross section of the ridge portion at the boundary of the small portions can be reduced. Therefore, the stiffness of the dome portion can be increased as compared to a case where the small portions are planar.

Moreover, in the diaphragm in which the ridge portions each having the mountain shape and the ridge portions each having the valley shape are formed, a material of the dome portion may be a resin.

Moreover, in the above diaphragm, the dome portion may include an arch portion extending from a top portion thereof to an outer edge portion thereof, and the arch portion may be formed by the ridge portions. In accordance with this configuration, each of the ridge portions serving as the frames extends from the top portion to the outer edge portion. Therefore, the tension of maintaining the expanding shape of the dome portion acts. Thus, the stiffness of the diaphragm can be increased.

Moreover, in the above diaphragm, the arch portion may be formed by the ridge portions each having a curved shape and may have a circular-arc shape.

Moreover, in the above diaphragm, the arch portion may be formed by the ridge portions each having a linear shape and may have a substantially circular-arc shape.

Moreover, in the above diaphragm, the arch portion may be one of a plurality of arch portions.

Moreover, in the above diaphragm, the dome portion may include a plurality of side arch portions each extending from one portion of the outer edge portion to the other portion of the outer edge portion, and when viewed from a direction passing through the top portion and perpendicular to the dome portion, the side arch portion may be substantially linear, extend substantially in parallel with the arch portion, and be formed by the ridge portions. In accordance with this configuration, the tension of maintaining the expanding shape of the dome portion further acts. Thus, the stiffness of the diaphragm can be further increased.

Moreover, in the above diaphragm, the side arch portion may have a substantially circular-arc shape.

Moreover, in the above diaphragm, on the dome portion, a plurality of ridge portion polygons may be formed by the ridge portions around an axis passing through the top portion of the dome portion and perpendicular to the dome portion. The ridge portions forming the ridge portion polygons may be the ridge portions each having a valley shape, and the ridge portions intersecting with the ridge portion polygons may be the ridge portions each having a mountain shape. In accordance with this configuration, the ridge portions each having the mountain shape and the ridge portions each having the valley shape can be efficiently increased.

Moreover, in the above diaphragm, the plurality of ridge portion polygons may be configured to gradually increase in size from a vicinity of the top portion to an outer edge portion.

Moreover, in the above diaphragm, assuming that a line using the top portion of the dome portion as a starting point and passing through a corner of one of the ridge portion polygons is a first virtual line, and a line using the top portion of the dome portion as a starting point and passing through a corner of the other ridge portion polygon located inwardly or outwardly adjacent to said one of the ridge portion polygons is a second virtual line, the ridge portion polygon having the corner overlapping the first virtual line and the ridge portion polygon having the corner overlapping the second virtual line may be alternately formed from the vicinity of the top portion to the outer edge portion. In accordance with this configuration, the angle of the cross section of the ridge portion in the vicinity of the outer edge of the dome portion is reduced. Therefore, the stiffness in the vicinity of the outer edge of the dome portion can be increased. With this, since vibrations of a voice coil easily transfer to the entire dome portion, frequency characteristics can be easily controlled.

Moreover, in the above diaphragm, the shapes of the small portions may be triangles, trapezoids, or triangles and trapezoids.

Moreover, in the above diaphragm, the small portion having a bottom side located on the top portion side and the small portion having a bottom side located on the outer edge portion side may be alternately formed in a circumferential direction of the ridge portion polygon.

Moreover, in the above diaphragm, the small portion having the bottom side located on the top portion side and the small portion having the bottom side located on the outer edge portion side may be alternately formed from the top portion to the outer edge portion.

Further, a speaker according to the present invention includes the above diaphragm.

Effects of the Invention

As is clear from the above explanation, in the diaphragm according to the present invention, the ridge portions are formed on the entire dome portion, and the ridge portions can serve as the frames for reinforcing the dome portion. Therefore, the present invention can provide the dome diaphragm having high strength wholly and uniformly while maintaining the small thickness of the dome portion. The present invention can also provide the dome speaker including such diaphragm.

BEST MODE FOR CARRYING OUT THE INVENTION

Figure 1:
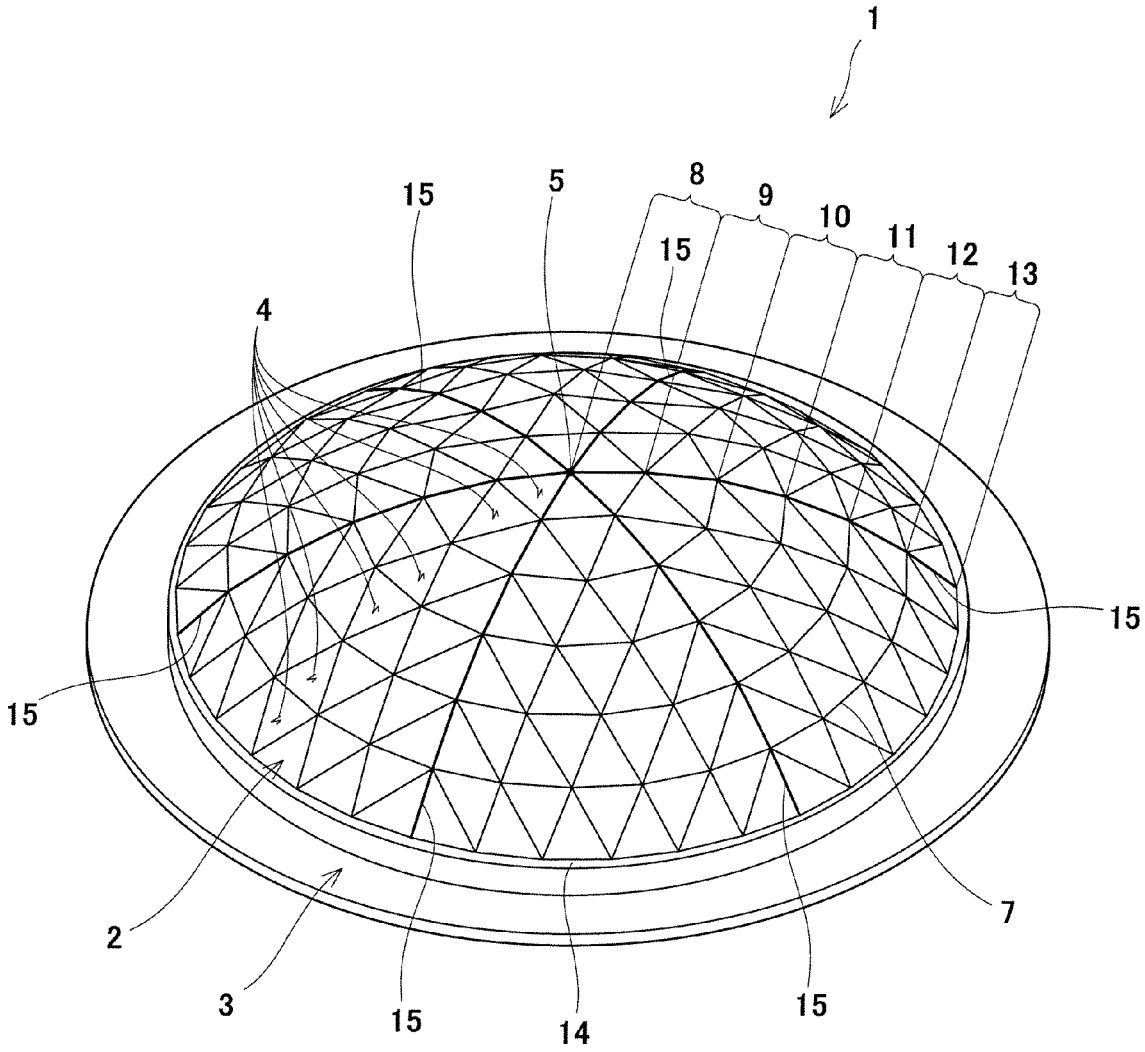
FIG. 1 is a perspective view of a diaphragm according to Embodiment 1 of the present invention.

Hereinafter, embodiments according to the present invention will be explained in reference to the drawings. In the drawings, the same reference signs are used for the same or corresponding components, and a repetition of the same explanation is avoided.

Embodiment 1

First, a diaphragm 1 according to Embodiment 1 will be explained. FIG. 1 is a perspective view of the diaphragm 1 according to the present embodiment. As shown in FIG. 1, the diaphragm 1 according to the present embodiment is mainly constituted by a dome portion 2 expanding in a dome shape and an edge portion 3 located at an outer peripheral portion of the dome portion 2. The dome portion 2 is divided into a plurality of small portions 4, and each small portion 4 has a planar triangle shape. A linear ridge portion 7 is formed at a boundary of the small portions 4. Further, the ridge portions 7 are formed over the entire dome portion 2 so as to each have a mountain shape. The sizes of the small portions 4 are substantially the same as one another over the entire dome portion 2.

Here, the arrangement of the small portions 4 in the diaphragm 1 according to the present embodiment will be further explained. As shown in FIG. 1, in the dome portion 2, the plurality of small portions 4 are connected to one another to form six layers 8 to 13 each surrounding a top portion 5. The first layer 8 closest to the top portion 5 is formed by six small portions 4 each having a corner located at the top portion 5 of the diaphragm 1, and an outer edge of the first layer 8 is a hexagon. The second layer 9 located on an outer side of the first layer 8 is formed by 18 small portions 4. One side of each of six out of 18 small portions 4 contacts a bottom side of one of the small portions 4 of the first layer 8 (each of six out of 18 small portions 4 shares one side with one of the small portions 4 of the first layer 8). Each of 12 out of 18 small portions 4 are provided adjacent to each of the above six small portions 4. An outer edge of the second layer 9 is a dodecagon. Similarly, the third layer 10 is formed by 30 small portions 4, and an outer edge thereof is an octadecagon. The fourth layer 11 is formed by 48 small portions 4, and an outer edge thereof is a twenty-four-sided polygon. The fifth layer 12 is formed by 54 small portions 4, and an outer edge thereof is a thirty-sided polygon. The sixth layer 13 is formed by 66 small portions 4, and an outer edge thereof is a thirty-six-sided polygon.

As above, the outer edges of the layers 8 to 13 of the dome portion 2 are polygons, and the polygon closer to the edge portion 3 is more similar to a circle. With this, since the outer edge of the sixth layer 13 located on an outermost side is very similar to a circle, an outer edge portion 14 of the dome portion 2 can be naturally coupled to the edge portion 3 having a circular shape. The small portion 4 does not have to be a regular triangle and does not necessarily have to be a proper triangle. For example, among the sides of the small portions 4, each of the sides forming the outer edge of each of the layers 8 to 13 may be formed to have a circular-arc shape such that the outer edge of each of the layers 8 to 13 becomes a circle. In accordance with this configuration, since the entire boundaries of the layers 8 to 13 become gently curved lines, it is possible to prevent the stress from concentrating on the boundaries of the small portions 4 which form the outer edges of the layers 8 to 13.

Moreover, as shown in FIG. 1, the dome portion 2 according to the present embodiment includes six arch portions 15 each extending from the top portion 5 to the outer edge portion 14. The linear ridge portions 7 of the layers 8 to 13 are connected to one another to form the arch portions 15 each having a substantially circular-arc shape. In other words, the ridge portions 7 of the small portions 4 of the layers 8 to 13 radially extend in six directions from the top portion 5 of the dome portion 2 so as to be spaced at regular intervals. In the present embodiment, in order to form the arch portions 15 on the dome portion 2, in the second to sixth layers 9 to 13, the small portions 4 each having a corner toward the top portion 5 are adjacently arranged across the boundary that is the arch portion 15. In FIG. 1, the arch portion 15 having a substantially circular-arc shape is formed by the linear ridge portions 7. However, the arch portion 15 having a circular-arc shape may be formed by the ridge portions 7 each having a curved shape.

Further, the diaphragm 1 according to the present embodiment can be manufactured using a mold corresponding to the shape of FIG. 1. To be specific, a so-called hard dome made of a metal or the like can be manufactured by a press work using the mold corresponding to the shape of FIG. 1. Moreover, in the case of a so-called soft dome made of cotton, chemical fiber, or the like impregnated with resin, or made by a resin film, the shape of the diaphragm 1 shown in FIG. 1 can be realized by hot forming using the mold corresponding to the shape of FIG. 1.

Moreover, the number of ridge portions 7 of the diaphragm 1 according to the present embodiment can be reduced as compared to, for example, a diaphragm 1B of Embodiment 3 described below. Therefore, the diaphragm 1 according to the present embodiment is suitable for a case where a comparatively hard material (material capable of increasing the stiffness of the dome portion 2) is used. For example, the diaphragm 1 according to the present embodiment is suitable for a case where the dome portion 2 is made of a metal, such as titanium.

Figure 2:
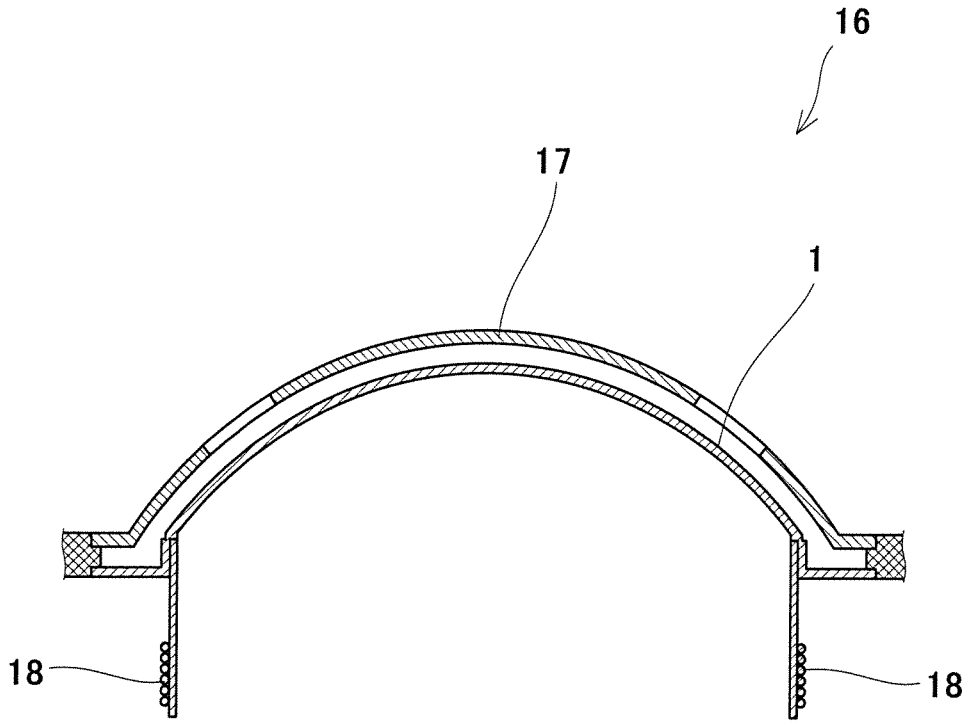
FIG. 2 is a schematic cross-sectional view of a speaker according to Embodiment 1 of the present invention.

Next, a speaker 16 according to Embodiment 1 will be explained. FIG. 2 is a schematic cross-sectional view of the speaker 16 according to the present embodiment. The speaker 16 according to the present embodiment is a dome speaker including the diaphragm 1 of FIG. 1. As shown in FIG. 2, the speaker 16 includes an equalizer 17 in front of the diaphragm 1. Moreover, the diaphragm 1 is connected to a voice coil 18 in the vicinity of the outer edge of the diaphragm 1, and the diaphragm 1 vibrates by the vibrations of the voice coil 18. As above, the speaker 16 according to the present embodiment is basically the same in configuration as a common dome speaker. Therefore, any special design change is unnecessary for the components other than the diaphragm 1.

The foregoing has explained the diaphragm 1 and the speaker 16 according to Embodiment 1. As above, in the diaphragm 1 according to the present embodiment, the dome portion 2 is divided into the plurality of small portions 4, and the ridge portion 7 is formed on each boundary of adjacent small portions 4. Since the ridge portions 7 serve as frames for reinforcing the dome portion 2, the strength (stiffness) of the diaphragm 1 can be improved.

Moreover, the ridge portions 7 are formed over the entire dome portion 2 of the diaphragm 1. Therefore, the strength of the entire dome portion 2 can be uniformly increased. To be specific, a strength difference among portions of the dome portion 2 can be suppressed.

Moreover, in accordance with the diaphragm 1 according to the present embodiment, since the strength of the diaphragm 1 can be improved without increasing the thickness of the dome portion 2, the small thickness of the dome portion 2 can be maintained. With this, the speaker 16 using the diaphragm 1 can reproduce sounds in a wide range from a low-pitched sound range to a high-pitched sound range.

Moreover, the diaphragm 1 according to the present embodiment does not change in shape so much or does not increase in weight as compared to the conventional diaphragm. Therefore, the diaphragm 1 according to the present embodiment can be incorporated in the speaker 16 without changing the conventional components, such as the voice coil 18.

Moreover, in the diaphragm 1 according to the present embodiment, a plurality of arch portions 15 each extending from the top portion 5 to the outer edge portion 14 of the dome portion 2 are formed by the ridge portions 7. Therefore, a tension of maintaining the shape of the dome portion 2 expanding in the dome shape acts. On this account, such configuration is very effective to increase the stiffness of the speaker 16 having the dome shape.

Embodiment 2

Figure 3:
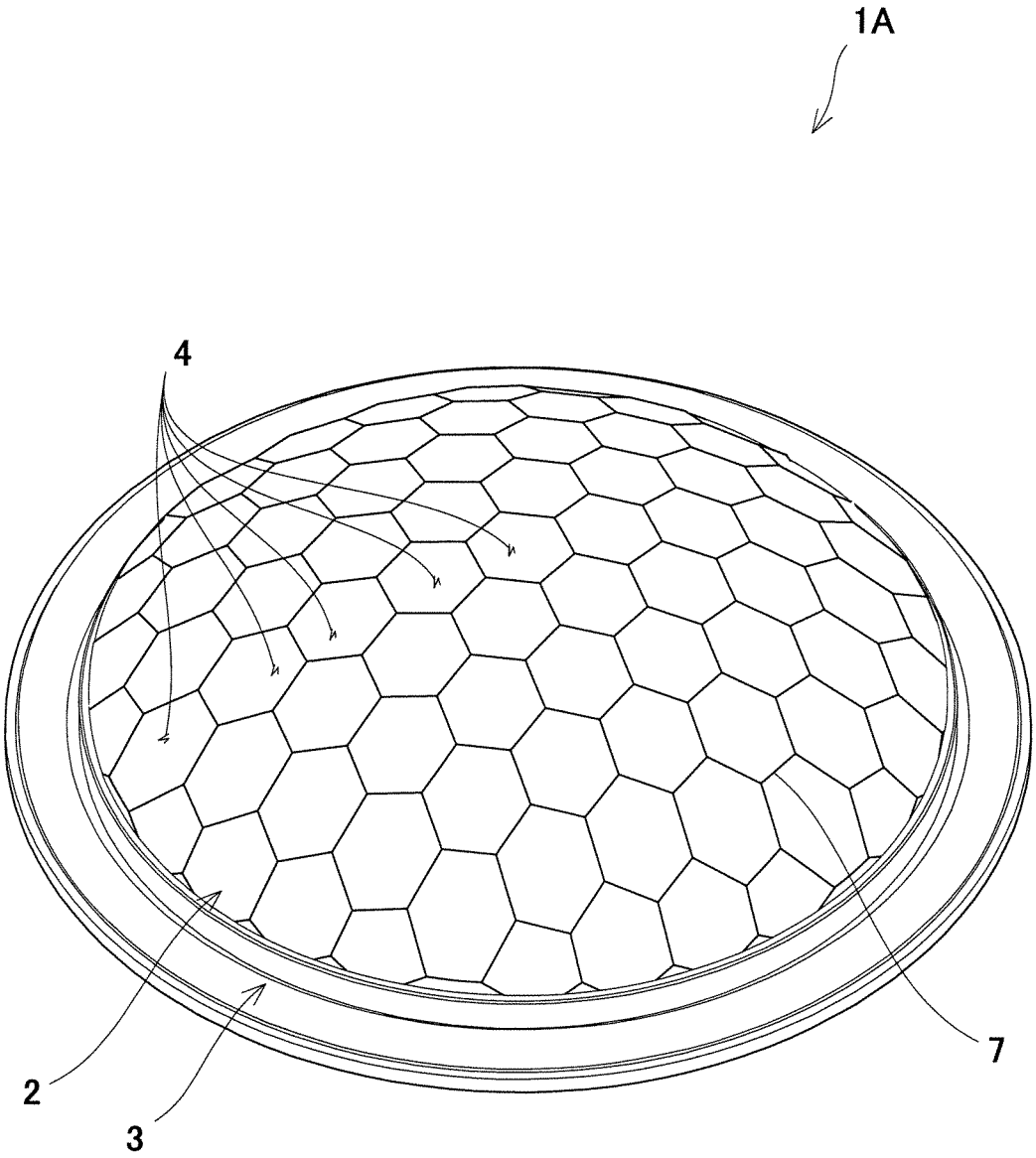
FIG. 3 is a perspective view of the diaphragm according to Embodiment 2 of the present invention.

Next, a diaphragm 1A according to Embodiment 2 will be explained. FIG. 3 is a perspective view of the diaphragm 1A according to the present embodiment. As shown in FIG. 3, as with the diaphragm 1 of Embodiment 1, the diaphragm 1A according to the present embodiment is mainly constituted by the dome portion 2 expanding in the dome shape and the edge portion 3 located the outer peripheral portion of the dome portion 2, and the dome portion 2 is divided into a plurality of small portions 4. However, the diaphragm 1A according to the present embodiment is different in configuration from the diaphragm 1 according to Embodiment 1 in that: the small portion 4 of the diaphragm 1 according to Embodiment 1 has the planar triangle shape whereas the small portion 4 of the diaphragm 1A according to the present embodiment has a planar hexagon shape.

Even in the case of the above configuration of the diaphragm 1A according to the present embodiment, the linear ridge portion 7 can be formed at the boundary of the small portions 4, and the sizes of the small portions 4 can be substantially the same as one another over the entire dome portion 2. Therefore, the strength (stiffness) of the entire diaphragm 1A can be improved while suppressing the strength difference among portions of the dome portion 2.

Embodiments 1 and 2 have explained a case where the small portion 4 has the planar triangle shape or the planar hexagon shape. However, the small portion 4 may have a planar polygon shape other than the planar triangle shape and the planar hexagon shape. For example, the small portion 4 has a planar quadrangle shape, or the small portions 4 of different planar polygons may exist in the same dome portion 2 (for example, a combination of the planar triangle and the planar quadrangle or a combination of a planar pentagon and the planar hexagon). In a case where the small portion 4 has the planar quadrangle shape having corners corresponding to corners of two adjacent small portions 4 shown in FIG. 1, the small portions 4 each having the planar quadrangle shape become substantially the same in area as one another. Needless to say, the small portion 4 having the planar quadrangle shape may be formed by a method other than the above method.

As above, various planar polygons may be used as the shape of the small portion 4. Among the planar polygons, the planar triangle is higher in the degree of freedom of the arrangement than the other polygons. Therefore, in a case where the small portion 4 has the planar triangle shape, it is possible to easily suppress variation in the areas of the small portions 4. If the dome portion 2 can be divided into the small portions 4 which are substantially the same in area as one another, the strength of the entire dome portion 2 can be substantially uniformized.

Embodiment 3

Figure 4:
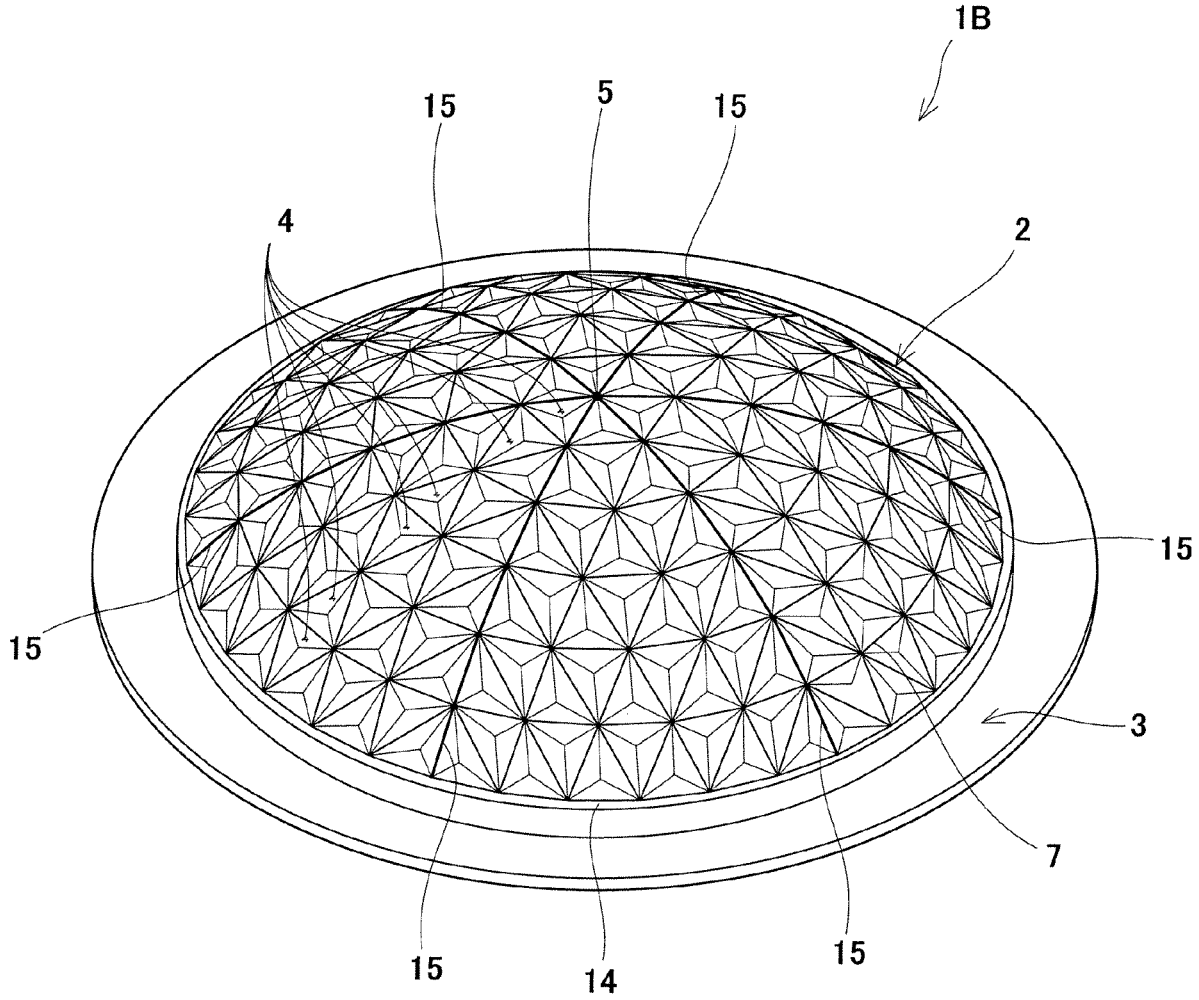
FIG. 4 is a perspective view of the diaphragm according to Embodiment 3 of the present invention.

Next, the diaphragm 1B according to Embodiment 3 will be explained. FIG. 4 is a perspective view of the diaphragm 1B according to the present embodiment. As with Embodiment 1, the diaphragm 1B according to the present embodiment is mainly constituted by the dome portion 2 expanding in the dome shape and the edge portion 3 located at the outer peripheral portion of the dome portion 2, and the dome portion 2 is divided into a plurality of small portions 4. In addition, the ridge portion 7 is formed at the boundary of the small portions 4. However, the diaphragm 1B according to the present embodiment is different in configuration from the diaphragm 1 according to Embodiment 1 in that the ridge portions 7 of the diaphragm 1 according to Embodiment 1 are formed in a mountain shape over the entire dome portion 2 whereas the ridge portions 7 of the diaphragm 1B according to the present embodiment are formed in a mountain shape and a valley shape over the entire dome portion 2. Further, in the present embodiment, a triangular pyramid is formed using three adjacent small portions 4 as three surfaces. In this case, a remaining surface (bottom surface) forming the triangular pyramid is an opening surface which opens to outside. For ease of comparison, the opening surface shown in FIG. 4 and the small portion 4 shown in FIG. 1 are the same in position and size as each other.

Figure 5:
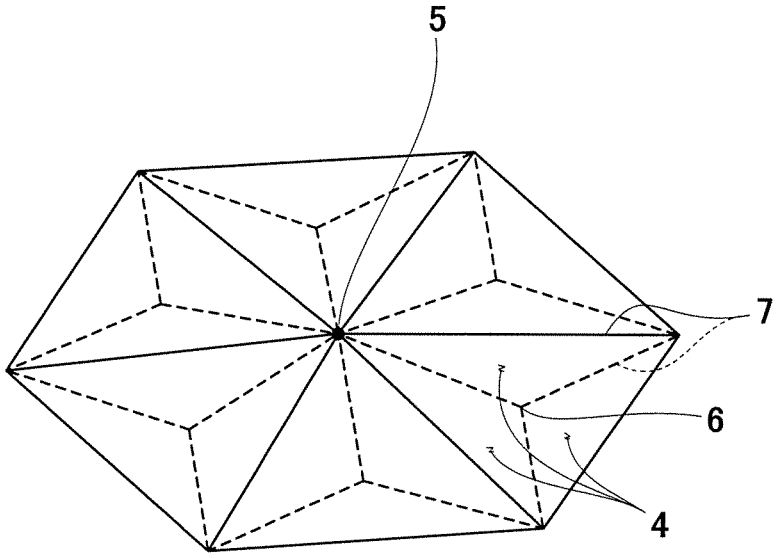
FIG. 5 is a partially enlarged view of the diaphragm according to Embodiment 3 of the present invention.

FIG. 5 is an enlarged view of the dome portion 2 shown in FIG. 4 and enlarges the vicinity of the top portion 5 of the dome portion 2. In FIG. 5, solid lines show the ridge portion 7 formed in the mountain shape, and dotted lines show the ridge portion 7 formed in the valley shape. As is clear from FIG. 5, three small portions 4 form the triangular pyramid in which a deepest portion 6 is a corner and the opening surface opening to outside is the bottom surface. The triangular pyramid is not formed by digging in the surface of the dome portion 2 but is formed by bending the surface of the dome portion 2. Therefore, the thicknesses of the small portions 4 are uniform over the entire dome portion 2. For example, an inwardly depressed portion when viewed from the outer side (front side) of the diaphragm 1B is inwardly depressed when viewed from the inner side (back side) of the diaphragm 1B.

As above, in the diaphragm 1B according to the present embodiment, the ridge portion 7 having the mountain shape is formed at the boundary of the triangular pyramids, and in addition, the ridge portion 7 having the valley shape is formed at the boundary of the small portions 4 forming the triangular pyramid. Therefore, in the present embodiment, the number of ridge portions 7 is larger than that of the diaphragm 1 according to Embodiment 1. In addition, since both the ridge portion having the mountain shape and the ridge portion having the valley shape are formed, an angle of a cross section of the ridge portion 7 formed at the boundary of the small portions 4 (an angle formed between two small portions 4 forming the ridge portion 7) can be made sharp (can be made small). With this, the strength of the ridge portion 7 with respect to a force applied from a direction perpendicular to the curved surface of the dome portion 2 improves. Thus, the stiffness of the diaphragm 1B can be further increased.

The diaphragm 1B according to the present embodiment can be increased in stiffness as compared to the diaphragm 1 according to Embodiment 1. Therefore, the diaphragm 1B according to the present embodiment is suitable for a case where a material that is softer than the material used for the diaphragm 1 according to Embodiment 1 is used. For example, the diaphragm 1B according to the present embodiment is suitable for a case where the dome portion 2 is manufactured using a resin, such as polyimide.

Figure 6:
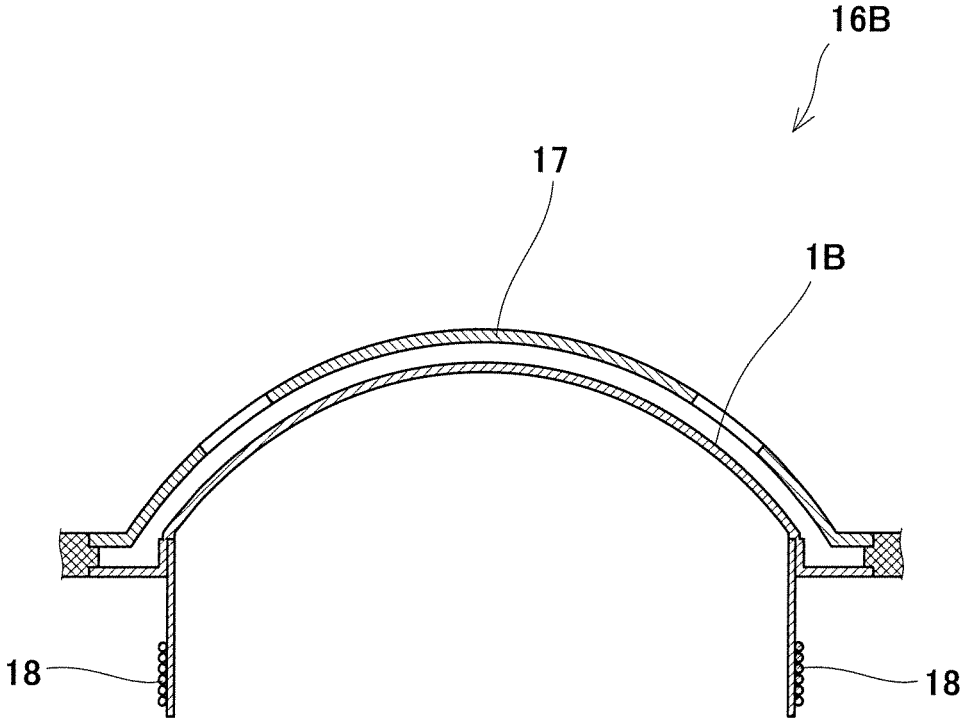
FIG. 6 is a schematic cross-sectional view of the speaker according to Embodiment 3 of the present invention.

Next, a speaker 16B according to Embodiment 3 will be explained. FIG. 6 is a schematic cross-sectional view of the speaker according to the present embodiment. The speaker 16B according to the present embodiment is basically the same in configuration as the speaker 16 according to Embodiment 1 (see FIG. 2) but is different from the speaker 16 according to Embodiment 1 in that the speaker 16B according to the present embodiment uses the diaphragm 1B (see FIG. 4) instead of the diaphragm 1.

In the actual speaker 16B, a gap between the equalizer 17 and the diaphragm 1B is very small. However, since the triangular pyramid (see FIG. 4) formed by the small portions 4 on the dome portion 2 of the diaphragm 1B is inwardly depressed (has a concave shape), the diaphragm 1B and the equalizer 17 are unlikely to contact each other. However, unlike the configuration of the speaker 16B according to the above embodiments, in a case where the speaker 16B includes a compression driver (not shown) behind (on an inner side of) the diaphragm 1B, and the gap between the diaphragm 1B and the compression driver is very small, the triangular pyramid on the dome portion 2 of the diaphragm 1B may be formed to project outwardly (to be convex). In this case, the opening surface of the triangular pyramid opens to the inside of the dome portion 2. Even in a case where the triangular pyramid is formed to project outwardly (to be convex), the ridge portion 7 is formed at the boundary of the small portions 4, and the ridge portion 7 serves as a frame for reinforcing the dome portion 2. Therefore, the same effects as in a case where the triangular pyramid formed by the small portions 4 is inwardly depressed can be obtained.

Embodiment 4

Figure 7:
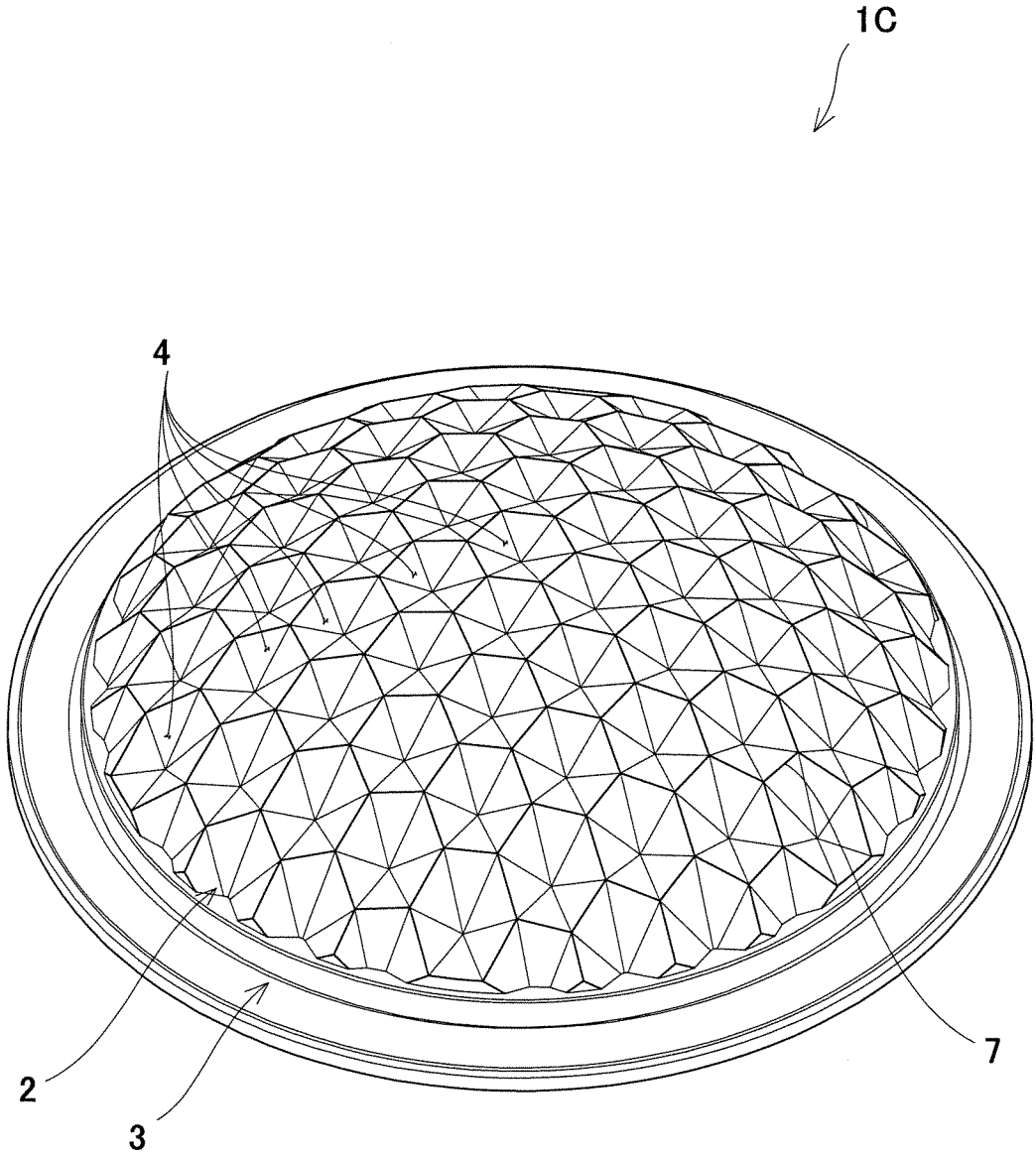
FIG. 7 is a perspective view of the diaphragm according to Embodiment 4 of the present invention.

Next, a diaphragm 1C according to Embodiment 4 will be explained. FIG. 7 is a perspective view of the diaphragm 1C according to the present embodiment. As shown in FIG. 7, as with Embodiment 3, the diaphragm 1C according to the present embodiment is mainly constituted by the dome portion 2 expanding in the dome shape and the edge portion 3 located at the outer peripheral portion of the dome portion 2, and the dome portion 2 is divided into a plurality of small portions 4. However, the diaphragm 1C according to the present embodiment is different in configuration from the diaphragm 1B according to Embodiment 3 in that the triangular pyramid in the diaphragm 1B of Embodiment 3 is formed using three adjacent small portions 4 as three surfaces whereas a six-sided pyramid in the diaphragm 1C according to the present embodiment is formed using six adjacent small portions 4 as six surfaces.

For ease of comparison, the small portion 4 of FIG. 3 and the opening surface (bottom surface) of the six-sided pyramid of FIG. 7 are the same in position and size as each other. Even in a case where the dome portion 2 is configured as shown in FIG. 7, the ridge portion 7 is formed at the boundary of the adjacent small portions 4. Therefore, the ridge portions 7 serve as frames for reinforcing the dome portion 2. Thus, the strength (stiffness) of the diaphragm 1C can be improved.

The foregoing has explained a case where the small portions 4 form the triangular pyramid or the six-sided pyramid. However, the small portions 4 may form a plural-sided pyramid other than the triangular pyramid and the six-sided pyramid. For example, a four-sided pyramid may be formed by the small portions 4, or different plural-sided pyramids may be formed in the same dome portion 2 (for example, a combination of the triangular pyramid and the four-sided pyramid or a combination of a five-sided pyramid and the six-sided pyramid). In a case where the small portions 4 form the four-sided pyramid having the bottom surface (opening surface) of corners corresponding to corners of the bottom surfaces (opening surfaces) of two adjacent triangular pyramids shown in FIG. 4, the four-sided pyramids which are substantially the same in size as one another can be formed in the entire dome portion 2.

Further, the foregoing has explained a case where the dome portion 2 is formed by a plurality of plural-sided pyramids. However, the dome portion 2 may be formed by depressed portions (for example, hemispherical depressed portions) other than the plural-sided pyramids. In other words, the small portions 4 of the diaphragms 1 and 1A shown in FIGS. 1 and 3 may be formed to be inwardly depressed (in a hemispherical shape for example) or project outwardly. Even in this configuration, the angle of the cross section of the ridge portion 7 formed at the boundary of the small portions 4 (the angle formed between two small portions 4 forming the ridge portion) can be made sharp (can be made small). Therefore, even in this case, the strength of the ridge portion 7 with respect to the force applied from the direction perpendicular to the curved surface of the dome portion 2 improves. Thus, the stiffness of the diaphragm 1C can be increased.

Embodiment 5

Figure 8:
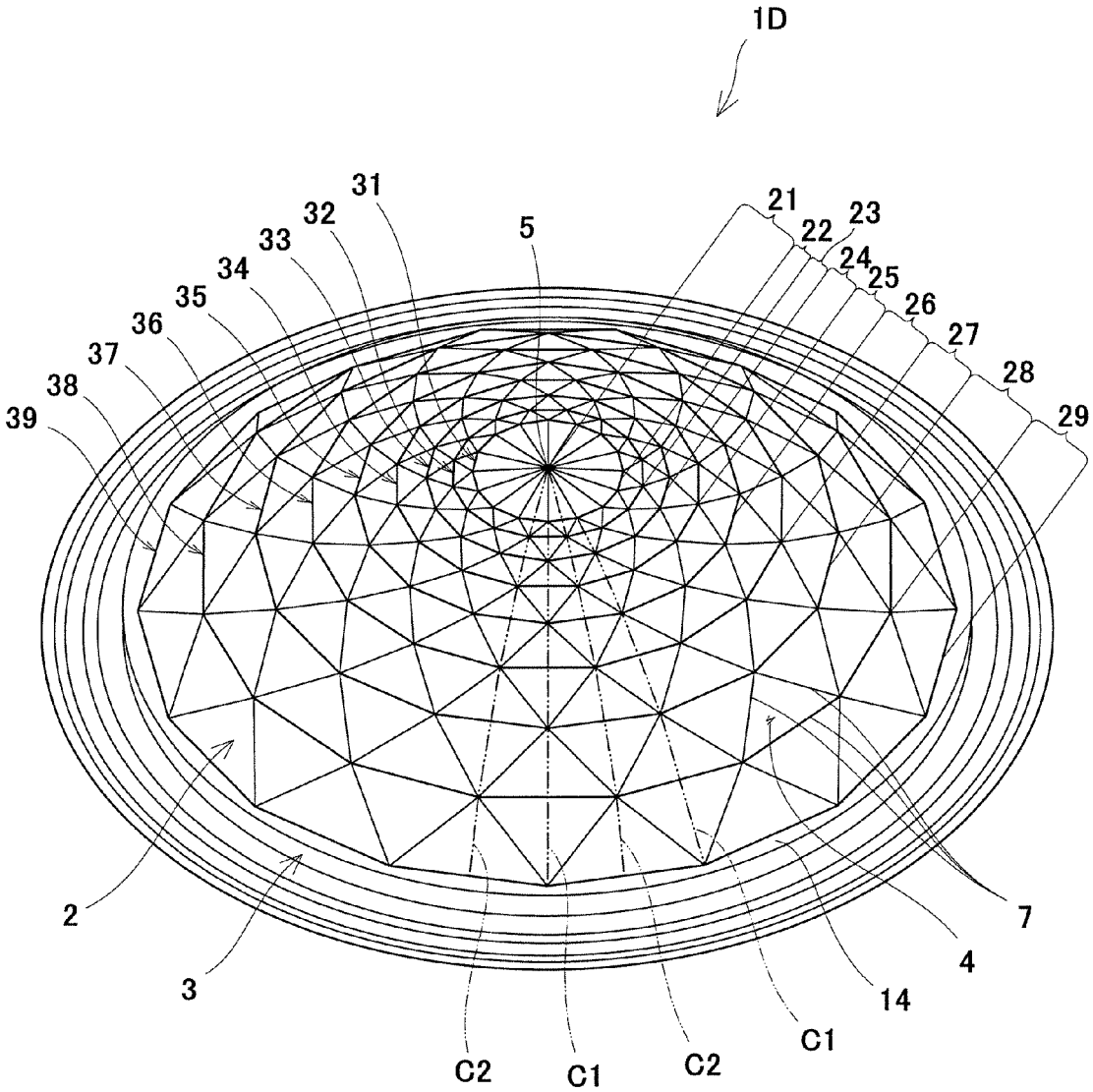
FIG. 8 is a perspective view of the diaphragm according to Embodiment 5 of the present invention.

Next, a diaphragm 1D according to Embodiment 5 will be explained. FIG. 8 is a perspective view of the diaphragm 1D according to the present embodiment. As with Embodiment 1 and the like, the diaphragm 1D according to the present embodiment is mainly constituted by the dome portion 2 expanding in the dome shape and the edge portion 3 located at the outer peripheral portion of the dome portion 2, and the dome portion 2 is divided into a plurality of small portions 4. In addition, the ridge portion 7 is formed at the boundary of the small portions 4. Further, as with Embodiments 3 and 4, the ridge portion 7 having the mountain shape and the ridge portion 7 having the valley shape exist over the entire dome portion 2 in the diaphragm 1D according to the present embodiment. However, the diaphragm 1D according to the present embodiment is different in configuration from the diaphragms 1 to 1C according to Embodiments 1 to 4 in that the sizes of the small portions 4 are the same as one another in the entire dome portion 2 of each of the diaphragms 1 to 1C according to Embodiments 1 to 4 whereas the sizes of the small portions 4 in the vicinity of the top portion of the dome portion 2 are small but the sizes of the small portions 4 in the vicinity of the edge portion 3 are large in the diaphragm 1D according to the present embodiment.

Here, the arrangement of the small portions 4 of the diaphragm 1D according to the present embodiment will be further explained. As shown in FIG. 8, in the dome portion 2, a plurality of small portions 4 are connected to one another to form nine layers 21 to 29 from the top portion 5 to the outer edge portion 14. The first layer 21 closest to the top portion 5 is formed by 16 small portions 4 each having a corner located at the top portion 5 of the diaphragm 1, and an outer edge of the small portion is a hexadecagon. The second layer 22 located on an outer side of the first layer 21 is formed by 32 small portions 4. One side of each of 16 out of 32 small portions 4 contacts a bottom side of one of the small portions 4 of the first layer 21 (each of 16 out of 32 small portions 4 shares one side with one of the small portions 4 of the first layer 21). Each of the remaining 16 small portions 4 is located between the above small portions 4 each contacting the bottom side of one of the small portions 4 of the first layer 21. An outer edge of the second layer 22 is a hexadecagon. Similarly, each of the third to ninth layers 23 to 29 is formed by 32 small portions 4, and an outer edge thereof is a hexadecagon.

Further, corners of the hexadecagon of each of odd-numbered layers (odd-numbered layers counted from the top portion 5) that are the first, third, fifth, seventh, and ninth layers 21, 23, 25, 27, and 29 are located on first virtual lines C1 passing through the top portion 5, and corners of the hexadecagon of each of even-numbered layers (even-numbered layers counted from the top portion 5) that are the second, fourth, sixth, and eighth layers 22, 24, 26, and 28 are located on second virtual lines C2 passing through the top portion 5. The first virtual line C1 and the second virtual line C2 do not overlap each other and are spaced apart from each other in a circumferential direction. Specifically, one of the first virtual line C1 and the second virtual line C2 is located at a center between the other virtual lines, and the other one of the first virtual line C1 and the second virtual line C2 is located at a center between the remaining virtual lines. The small portions 4 are arranged in the diaphragm 1D to realize such configuration.

In other words, nine ridge portion polygons 31 to 39 are formed by the ridge portions 7 in the dome portion 2 so as to surround the top portion 5 and gradually increase in size from the vicinity of the top portion 5 to the outer edge portion 14. In a plan view from a direction passing through the top portion 5 and perpendicular to the dome portion 2, the ridge portion polygons 31, 33, 35, 37, and 39 having the corners overlapping the first virtual lines C1 and the ridge portion polygons 32, 34, 36, and 38 having the corners overlapping the second virtual lines C2 are alternately formed from the vicinity of the top portion 5 to the outer edge portion 14. The small portions 4 are arranged in the diaphragm 1D to realize such configuration. In FIG. 8, the first virtual lines C1 and the second virtual lines C2 are shown only on a near side of the sheet of the dome portion 2. However, this is not limited to the near side of the sheet. Even if the first virtual lines C1 and the second virtual lines C2 are shown over the entire dome portion 2, all the corners of the ridge portion polygons 31, 33, 35, 37, and 39 overlap the first virtual lines C1, and all the corners of the ridge portion polygons 32, 34, 36, and 38 overlap the second virtual lines C2.

Further, in other words, nine hexadecagonal ridge portion polygons 31 to 39 are formed in the dome portion 2 by coupling the ridge portions 7, the ridge portion polygons 31 to 39 gradually increase in size from the vicinity of the top portion 5 to the outer edge portion 14 so as to surround the top portion 5, and each of the centers of the ridge portion polygons 31 to 39 corresponds to an axis passing through the top portion 5 and penetrating the dome portion 2 perpendicularly. Among a plurality of ridge portions 7 formed in the dome portion 2, each of the ridge portions 7 forming the ridge portion polygons 31 to 39 has a valley shape whereas each of the ridge portions intersecting with the ridge portion polygons 31 to 39 has a mountain shape. Moreover, the triangular small portion having a corner located toward the top portion 5 and having a side opposed to this corner and located toward the outer edge portion 14 (small portion having a bottom side located toward the outer edge portion 14) and the triangular small portion having a corner located toward the outer edge portion 14 and having a side opposed to this corner and located toward the top portion 5 (small portion having a bottom side located toward the top portion 5) are alternately formed (in a circumferential direction of the ridge portion polygon) between a certain ridge portion polygon and the other ridge portion polygon located inwardly or outwardly adjacent to the certain ridge portion polygon. Further, the small portion having the bottom side located toward the top portion 5 and the small portion having the bottom side located toward the outer edge portion 14 are alternately formed from the top portion 5 to the outer edge portion 14. The small portions 4 are arranged in the diaphragm 1D to realize such configuration.

By configuring the diaphragm 1D according to the present embodiment as above, the ridge portions 7 each having the mountain shape and the ridge portions 7 each having the valley shape can be efficiently increased in the vicinity of the top portion 5 of the dome portion 2. Moreover, since a large number of ridge portions 7 can be arranged in the vicinity of the top portion 5 of the dome portion 2, this is effective in a case where a force is applied to the vicinity of the top portion 5.

In the diaphragm 1D shown in FIG. 8, the shapes of the small portions 4 are triangular. However, the shapes of the small portions 4 may be trapezoidal or may be both triangular and trapezoidal. For example, the triangular small portion 4 of FIG. 8 can be converted into the trapezoidal small portion 4 by replacing the corner opposed to the side (ridge portion) forming a part of the ridge portion polygon 31 to 39 with the ridge portion parallel to the side (ridge portion) forming a part of the ridge portion polygon 31 to 39. In this case, the trapezoidal small portion having a short side located toward the top portion 5 and a long side (bottom side) located toward the outer edge portion 14 (small portion having the bottom side located toward the outer edge portion 14) and the trapezoidal small portion having a short side located toward the outer edge portion 14 and a long side (bottom side) located toward the top portion 5 (small portion having the bottom side located toward the top portion 5) are alternately formed (in a circumferential direction of the ridge portion polygon) between a certain ridge portion polygon and the other ridge portion polygon located inwardly or outwardly adjacent to the certain ridge portion polygon. The small portion having the bottom side located toward the top portion 5 and the small portion having the bottom side located toward the outer edge portion 14 are alternately formed from the top portion 5 to the outer edge portion 14.

Embodiment 6

Figure 9:
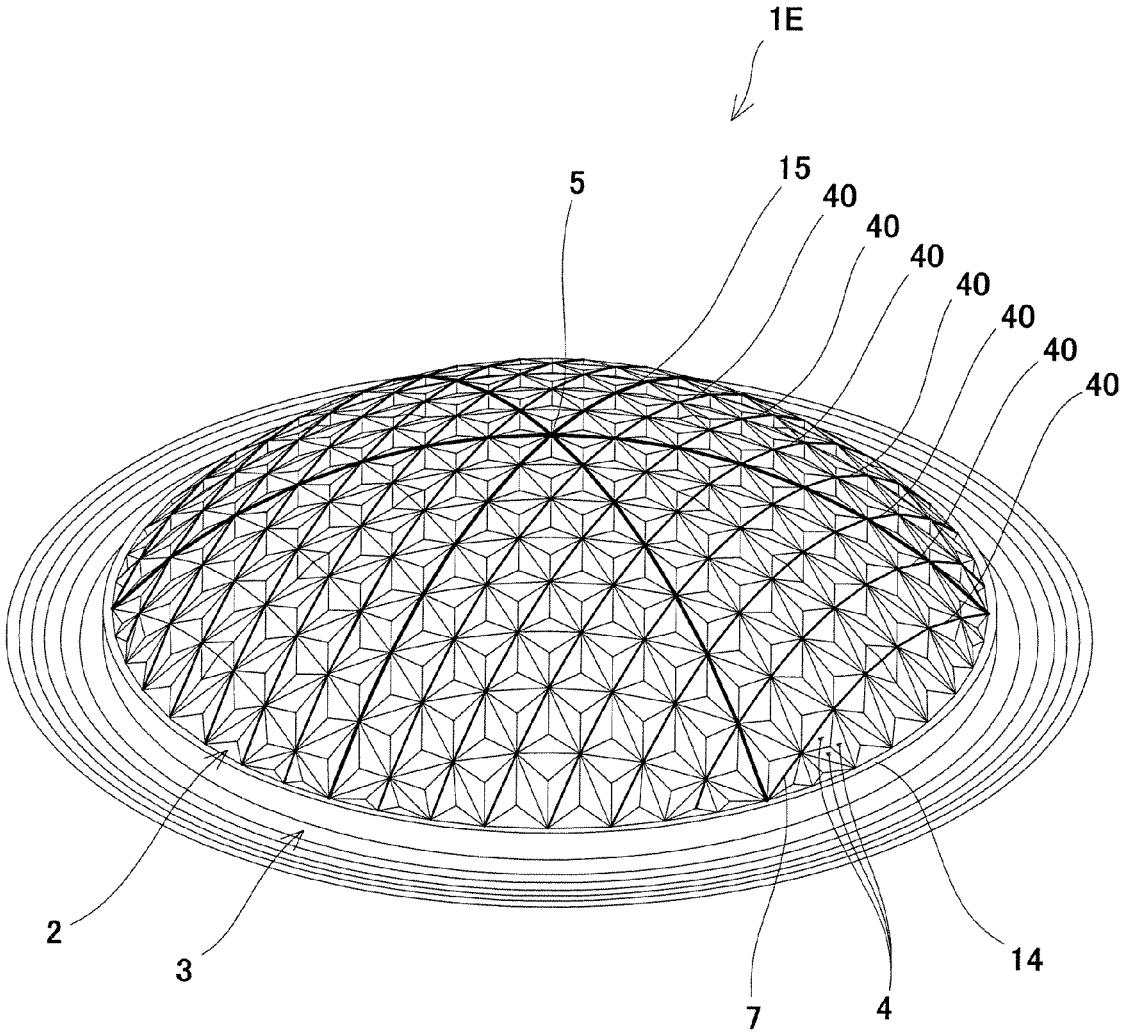
FIG. 9 is a perspective view of the diaphragm according to Embodiment 6 of the present invention.

Next, a diaphragm 1D according to Embodiment 5 will be explained. FIG. 9 is a perspective view of the diaphragm 1E according to the present embodiment. As with Embodiment 1 and the like, the diaphragm 1E according to the present embodiment is mainly constituted by the dome portion 2 expanding in the dome shape and the edge portion 3 located at the outer peripheral portion of the dome portion 2, and the dome portion 2 is divided into a plurality of small portions 4. In addition, as with Embodiment 3, the triangular pyramid is formed using three adjacent small portions 4 as three surfaces. Further, as with the diaphragm 1 according to Embodiment 1 and the diaphragm 1B according to Embodiment 3, the dome portion 2 of the diaphragm 1E according to the present embodiment includes six substantially circular-arc arch portions 15 formed by the ridge portions 7. However, the diaphragm 1E according to the present embodiment is different in configuration from the diaphragm 1 according to Embodiment 1 and the diaphragm 1B according to Embodiment 3 in that the dome portion thereof includes not only the arch portions 15 but also a plurality of substantially circular-arc side arch portions 40 each extending from one portion of the outer edge portion 14 to the other portion of the outer edge portion 14.

Figure 10:
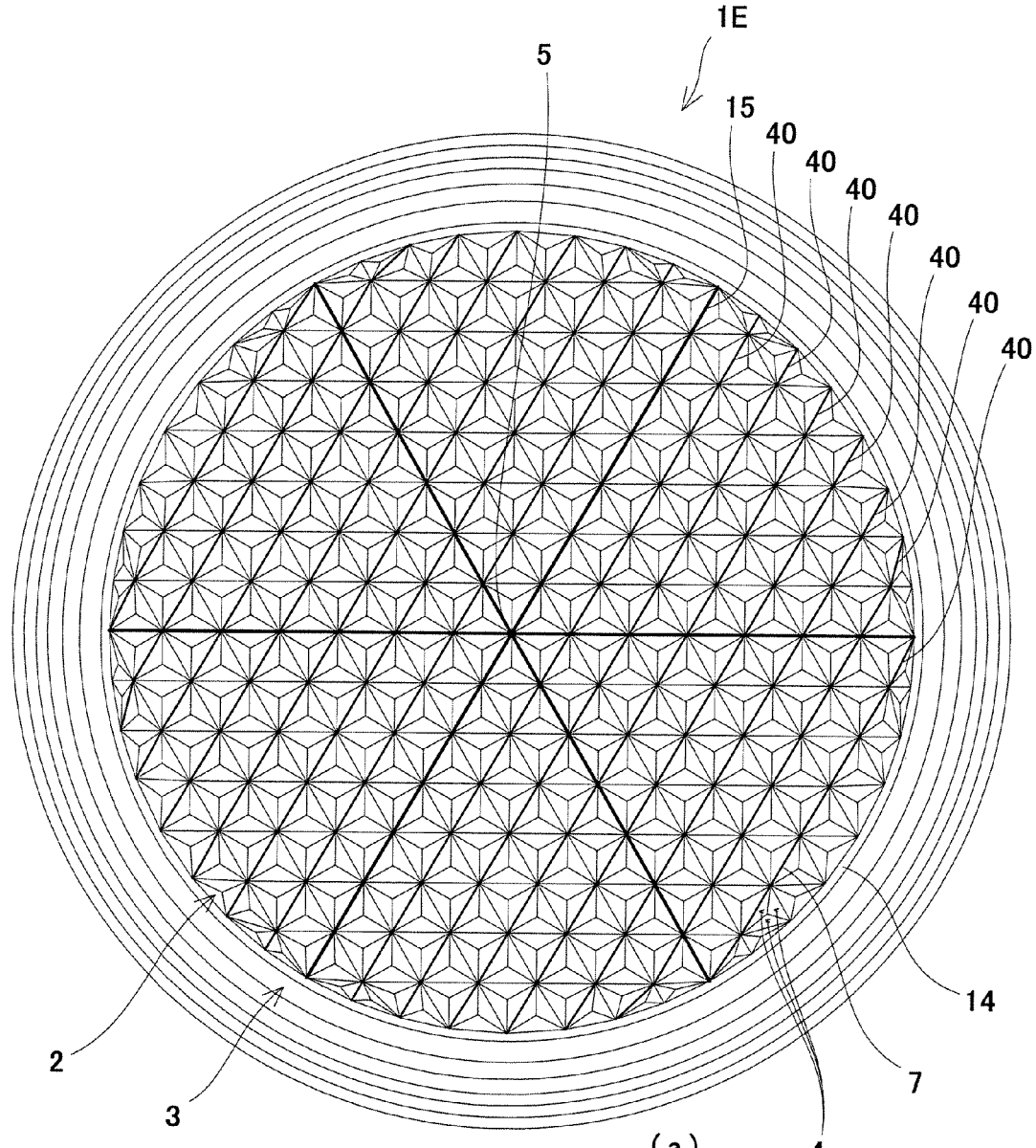
FIG. 10 are respectively a plan view and a side view of the diaphragm according to Embodiment 6 of the present invention.
Figure 10:
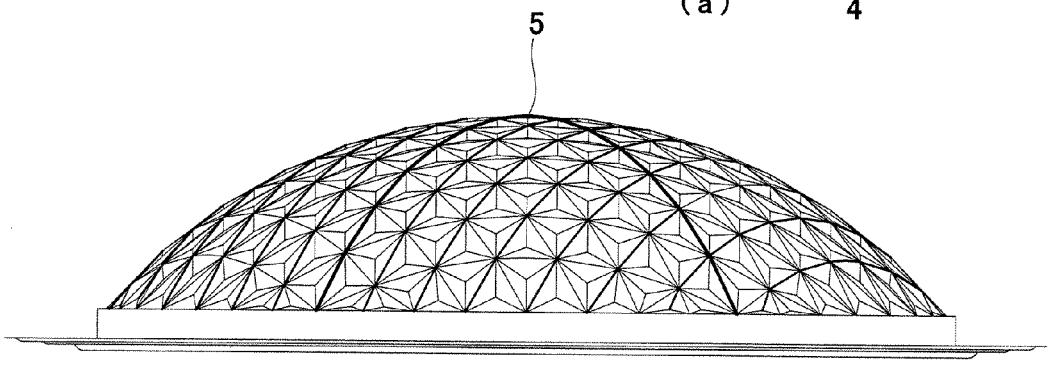

FIGS. 10(*a*) and 10(*b*) are respectively a plan view and a side view of the diaphragm 1E according to the present embodiment. As shown in FIG. 10(*a*), when viewed from a direction passing through the top portion 5 and perpendicular to the dome portion 2, the side arch portion 40 is linear, extends in parallel with the arch portion 15, and is formed by the ridge portions 7. As above, since the dome portion 2 of the diaphragm according to the present embodiment includes not only the arch portions 15 but also the side arch portions 40, the tension of maintaining the dome shape of the dome portion 2 further acts. Thus, the stiffness of the entire diaphragm 1E improves. In FIGS. 9 and 10, only a part of the side arch portions 40 are numbered. However, needless to say, in plan view, a plurality of side arch portions intersecting with the numbered side arch portions 40 at 120° and 240° are also formed on the dome portion 2.

In the diaphragm 1E of FIG. 10, when viewed from the direction passing through the top portion 5 and perpendicular to the dome portion 2, the side arch portion 40 is linear and extends in parallel with the arch portion 15. However, the side arch portion 40 may be substantially linear, which includes a polygonal line and a curved line. Moreover, the side arch portion 40 may extend substantially in parallel with the arch portion 15, which includes a case where the side arch portion 40 is not strictly in parallel with the arch portion 15. Further, in the diaphragm 1E of FIG. 10, the side arch portion 40 is formed to have a substantially circular-arc shape by the linear ridge portions 7. However, the side arch portion 40 may be formed to have a circular-arc shape by the curved ridge portions 7. The same effect as the above configuration can be obtained by such configuration.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the spirit of the present invention.

INDUSTRIAL APPLICABILITY

As above, the present invention can provide the dome diaphragm having high strength wholly and uniformly while maintaining the small thickness of the dome portion. The present invention can also provide the dome speaker including such diaphragm. Therefore, the present invention is useful in a technical field of speakers.

The invention claimed is:

1. A dome diaphragm, comprising:

a dome portion;

a top portion located on a top of the dome portion;

an edge portion located at an outer peripheral portion of the dome portion;

the dome portion consisting of a plurality of polygonal planar small portions with the entire surface of the dome portion being divided into the plurality of polygonal planar small portions;

the plurality of polygonal planar small portions connecting to one another to form a plurality of layers from the top portion to the edge portion, each layer surrounding the top portion, wherein a number of the polygonal planar small portions forming a layer closer to the edge portion is greater than a number of the polygonal planar small portions forming a layer closest to the top portion, and wherein an outer edge of a layer closer to the edge portion is a polygon having more sides than an outer edge of the layer closest to the top portion, the outer edge of the layer closer to the edge portion forming a polygon that has a number of sides that is a multiple of the number of sides of the polygon forming the layer closest to the top portion; and every two adjacent polygonal planar small portions contact one another to form a plurality of linear ridge portions in each layer and across the layers so that the plurality of linear ridge portions are over the entire dome portion.

2. A dome diaphragm according to claim 1, further comprising:

a plurality of arch portions each of which is formed by at least some of the linear ridge portions connecting to one another across the layers, so as for each of the arch portions to extend from the top portion to the edge portion.

3. A dome diaphragm according to claim 1, wherein:

the polygons of the polygonal planar small portions closer to the edge portion are more similar to a circle.

4. A dome diaphragm according to claim 1, wherein:

the polygons of the polygonal planar small portions gradually increase in size from a vicinity of the top portion to the edge portion.

5. A dome diaphragm according to claim 1, further comprising:

a plurality of plural-sided pyramids each of which is formed by bending a predetermined number of adjacent polygonal planar small portions to constitute its surfaces wherein a remaining surface other than the predetermined number of the adjacent polygonal planar small portions is an opening open to outside.

6. A dome diaphragm according to claim 1, wherein:

the polygonal planar small portions are one of planar triangles, planar quadrangles, and planar hexagons.

7. A dome diaphragm according to claim 5, wherein:

each of the plural-sided pyramids are one of triangular pyramids consisting of three adjacent polygonal planar small portions, four-sided pyramids consisting of four adjacent polygonal planar small portions, and six-sided pyramids consisting of six adjacent polygonal planar small portions.

8. A speaker comprising the diaphragm according to claim 1.

9. A dome diaphragm according to claim 1, wherein the polygon forming the outer edge of the layer closest to the top portion has six sides and the polygon forming the outer edge of the layer closer to the edge portion has a number of sides that is at least one multiple of six greater than the number of sides of the polygon forming the layer closest to the top portion.

10. A dome diaphragm according to claim 9, wherein the dome portion comprises at least three layers.

11. A dome diaphragm according to claim 10, wherein a first layer has an outer edge forming a six-sided polygon, a second layer has an outer edge forming a twelve-sided polygon, and a third layer has an outer edge forming an eighteen-sided polygon.

12. A dome diaphragm according to claim 11, wherein a first layer has an outer edge forming a six-sided polygon, a second layer has an outer edge forming a twelve-sided polygon, a third layer has an outer edge forming an eighteen-sided polygon, and a fourth layer has an outer edge forming a twenty four-sided polygon.

13. A dome diaphragm comprising:

a dome portion;

a top portion located on a top of the dome portion;

an edge portion located at an outer peripheral portion of the dome portion;

the dome portion consisting of a plurality of polygonal planar small portions with the entire surface of the dome portion being divided into the plurality of planar small portions;

the plurality of polygonal planar small portions connecting to one another to form a plurality of layers from the top portion to the edge portion, each layer surrounding the top portion, wherein a number of the polygonal planar small portions forming a layer closer to the edge portion is greater than a number of the polygonal planar small portions forming a layer closer to the top portion, and wherein an outer edge of a layer closer to the edge portion is a polygon having more sides than an outer edge of a layer closer to the top portion;

every predetermined number of adjacent polygonal planar small portions being bended and connected to one another in a valley shape to form a plurality of plural-sided pyramids with an opening to outside in each layer; and every two adjacent polygonal planar small portions across two adjacent plural-sided pyramid contacts one another in a mountain shape to form a plurality of linear ridge portions in each layer and across the layers so that the plurality of linear ridge portions are over the entire dome surface.

14. A dome diaphragm comprising:

a dome portion;

a top portion located on a top of the dome portion;

an edge portion located at an outer peripheral portion of the dome portion;

the dome portion consisting of a plurality of plural-sided pyramids with the entire surface of the dome portion being divided into the plurality of plural-sided pyramids;

each plural-sided pyramid comprising a predetermined number of polygonal planar small portions bended and connected to one another in a valley shape and an opening to the outside;

the polygonal planar small portions connecting to one another in a mountain shape across the plural-sided pyramids to form a plurality of layers from the top portion to the edge portion, each layer surrounding the top portion, wherein a number of the polygonal planar small portions form a layer closer to the edge portion is greater than an number of the polygonal planar small portions forming a layer closer to the top portion, and wherein an outer edge of a layer closer to the edge portion is a polygon having more sides than an outer edge of a layer closer to the top portion;

every two adjacent polygonal planar small portions across two adjacent plural-sided pyramids contacts one another in a mountain shape to form a plurality of linear ridge portions in each layer and across the layers so that the plurality of linear ridge portions are over the entire dome portion.

15. A dome diaphragm according to claim 9, wherein the dome portion comprises at least four layers.

* * * * *